US005648629A

United States Patent [19]

Kozuki

[11] Patent Number: 5,648,629

[45] Date of Patent: Jul. 15, 1997

[54] ELECTRONIC MUSICAL INSTRUMENT WITH RESONANCE SOUNDS

[75] Inventor: Koichi Kozuki, Hamamatsu, Japan

[73] Assignee: Yamaha Corporation, Japan

[21] Appl. No.: 266,021

[22] Filed: Jun. 27, 1994

[30] Foreign Application Priority Data

Jun. 29, 1993 [JP] Japan ..... 5-159612

[51] Int. Cl.[6] ..... G10H 1/00; G10H 1/02

[52] U.S. Cl. ..... 84/660; 84/622; 84/625; 84/659; 84/DIG. 9; 84/DIG. 26

[58] Field of Search ..... 84/622, 625, 626, 84/630, 659, 660, 633, 665, 721, 746, DIG. 26, 661, 662, DIG. 9, 707

[56] References Cited

U.S. PATENT DOCUMENTS

| | | | |
|---|---|---|---|
| 4,264,784 | 4/1981 | Lorea | 179/1 GE |
| 4,982,644 | 1/1991 | Shibukawa | 84/627 |
| 5,198,604 | 3/1993 | Higashi et al. | 84/626 |
| 5,252,774 | 10/1993 | Hasebe et al. | 84/618 |
| 5,256,830 | 10/1993 | Takeuchi et al. | 84/625 |
| 5,455,380 | 10/1995 | Matsuda et al. | 84/662 |
| 5,498,834 | 3/1996 | Inagaki et al. | 84/622 |

*Primary Examiner*—William M. Shoop, Jr.
*Assistant Examiner*—Marlon T. Fletcher
*Attorney, Agent, or Firm*—Graham & James LLP

[57] ABSTRACT

An electronic musical instrument having a pitch designating unit capable of designating pitches of a plurality of tone signals to be generated, a plurality of tone signal generating channels for selectively generating and outputting a plurality of tone signals having a different pitch designated by the pitch designating unit, a mixing unit for mixing tone signals generated by the plurality of tone signal generating units, a plurality of resonance signal generating units each having a different resonance frequency characteristic, for receiving a mixed tone signal from the mixing unit and generating and outputting a plurality of different resonance signals, and an input level controller provided on the input side of the plurality of resonance signal generating units, for controlling a level of the mixed tone signal from the mixing unit for each resonance signal generating unit, in accordance with a pitch of each of a plurality of tone signals to be generated, and supplying the level controlled mixed tone signal to each resonance signal generating unit. The electronic musical instrument also has a sostenuto pedal detector, and when the sostenuto pedal is depressed, the input level controller may further adjust the level of the level controlled mixed tone signal corresponding to a pitch or pitches of generated tone signals.

27 Claims, 8 Drawing Sheets

ELECTRONIC MUSICAL INSTRUMENT WITH RESONANCE SOUNDS

BACKGROUND OF THE INVENTION a) Field of the Invention

The present invention relates to an electronic musical instrument, and more particularly to an electronic musical instrument capable of electronically realizing a resonance effect of a natural musical instrument such as a piano which has a resonance mechanism of a plurality of resonance plates provided for piano strings.

b) Description of the Related Art

In a natural musical instrument piano, each key is provided with a string and a hammer. In response to a key depression, the hammer strikes the string to cause vibration of the string. Each string is provided with a damper. The damper detaches from the string when the key is depressed, and touches the string when the key is released. A piano has also a sustain pedal (damper pedal). When the sustain pedal is depressed, dampers of all keys detach from the strings. Therefore, when the sustain pedal is depressed, music sounds are maintained to be produced and do not attenuate for a long period even if keys are released.

When a key is depressed while the sustain pedal is depressed, the hammer strikes the string and the latter vibrates. This vibration transmits to other strings via a frame or the like. If transmitted vibration induce a resonance of another string, this string starts vibrating even if the string is not struck, and generates a resonance sound. It has been proposed to realize an electronic musical instrument capable of generating such resonance sounds.

A conventional resonance sound generator will be described with reference to FIG. 5. FIG. 5 is a block diagram showing the fundamental structure of a tone signal generator and a resonance signal generator of a conventional electronic musical instrument.

A tone signal generator 50 generates a tone signal having a pitch corresponding to a depressed key, and gives this tone signal a desired tone color and an amplitude envelope corresponding to the states of a key depression, a key release, and a sustain pedal. The tone signal generator 50 has a plurality of tone signal forming channels 51-1 to **51-*n* and an adder 52**. When a key is depressed, one of the tone signal forming channels is assigned to this key by an unrepresented channel assignment means. If all the tone signal forming channels are generating tone signals and a new key is depressed, generation of a tone signal having a longest time lapse after the key release or a tone signal most attenuated is stopped and its channel is assigned to the newly depressed key. This process is generally called a truncate process.

An assigned tone signal forming channel **51-*i*** generates a tone signal having a pitch corresponding to the depressed key.

Each tone signal forming channel 51-1 to **51-*n* is connected to the adder 52. The adder 52 adds tone signals supplied from the tone signal forming channels 51-1 to 51-*n***.

A resonance signal generator 60 generates m resonance signals having a different resonance frequency in accordance with an inputted tone signal, and adds a resonance signal to an original tone signal. The resonance signal generator 60 has m resonance signal forming channels 61-1 to **61-*m* and adders 65 and 66. Each resonance signal forming channel 61-1 to 61-*m* is supplied with a tone signal from the tone signal generator 50 and a sustain signal SUS from a sustain pedal switch 70**. The sustain signal SUS takes a level "1" when the sustain pedal is depressed, and a level "0" when it is released.

Each resonance signal forming channel is a comb filter with a circulating signal path. This comb filter is constituted by an adder 62, a multiplier 63, and a delay circuit 64.

The adder 62 adds an output of the delay circuit 64 to a tone signal supplied from the tone signal generator, and outputs the result to the multiplier 63.

The multiplier 63 gives the tone signal supplied from the adder 62 a predetermined feedback gain, and supplies the result to the delay circuit 64. The feedback gain can be set to a desired value by an unrepresented control means. An output of the multiplier 63 is an output of each resonance signal forming channel, and is inputted to the adder 65. In addition to a tone signal from the adder 62, a sustain signal SUS from the sustain pedal switch 70 is supplied to the multiplier 63. When the sustain signal SUS is "1", i.e., when the sustain pedal is depressed, the multiplier 63 provides a preset feedback gain. When the sustain signal SUS is "0", i.e., when the sustain pedal is released, the feedback gain at the multiplier 63 becomes null so that an output of the resonance signal forming channel is null.

The delay circuit 64 delays a signal supplied from the multiplier by a predetermined time, and supplies it to the adder 62. The delay time can be set to a desired value by an unrepresented control means. By setting the delay time to a proper value, the resonance frequency of the comb filter can be set to a desired value.

By supplying a tone signal from the tone signal generator 50 to each resonance signal forming channel 61-1 to **61-*m* constructed as above, it becomes possible for each resonance signal forming channel 61-1 to 61-*m*** to form a resonance signal having a specific resonance frequency.

The adder 65 adds the resonance signals supplied from the resonance signal forming channels 61-1 to **61-*m*, and supplies the result to the adder 66**.

The adder 66 adds a tone signal supplied from the tone signal generator 50 to the resonance signal, and supplies the result to a sound system 67.

The sound system 67 converts a digital tone signal supplied from the resonance signal generator 60 into an analog signal and produces sounds containing resonance sounds.

With the resonance signal generator shown in FIG. 5, an effective resonance sound can be produced when the sustain pedal is pushed down. However, when the sustain pedal is released, a resonance sound is not produced. In a natural musical instrument such as a piano, there is a case that a plurality of keys are depressed at the same time in an ordinary music play. In such a case, dampers of the depressed keys detach from the strings so that resonances occur at these strings even if the damper pedal is not pushed down. With the conventional resonance signal generator shown in FIG. 5, however, even if a plurality of keys are depressed at the same time without depressing the sustain pedal, such resonance sounds are not generated.

SUMMARY OF THE INVENTION

It is an object of the present invention to provide a resonance signal generator capable of generating an optimum resonance sound in accordance with the depression states of a sustain pedal and keys.

According to one aspect of the present invention, there is provided an electronic musical instrument including: pitch designating means capable of designating pitches of a plurality of tone signals to be generated; a plurality of tone signal generating means for selectively generating and outputting a plurality of tone signals having a different pitch designated by the pitch designating means; mixing means for mixing tone signals generated by the plurality of tone signal generating means; a plurality of resonance signal generating means each having a different resonance frequency characteristic, for receiving a mixed tone signal from the mixing means and generating and outputting a plurality of different resonance signals; and input level controlling means provided on the input side of the plurality of the resonance signal generating means, for controlling a level of the mixed tone signal from the mixing means for each of the resonance signal generating means, in accordance with a pitch of each of a plurality of tone signals to be generated, and supplying the level controlled mixed tone signal to each of the plurality of resonance signal generating means.

By providing the input level controlling means at the input side of each resonance signal generating means, a tone signal can be supplied only to the resonance signal generating means corresponding to a manipulation of such as a keyboard, and resonance signals for the keyboard manipulation can be generated. If a sustain pedal is depressed, a tone signal is supplied to all the resonance signal generating means so that resonance signals for all pitches can be generated.

If a plurality of keys of an electronic musical instrument are depressed at the same time without depressing the sustain pedal, it is also possible to generate resonance signals corresponding to only the depressed keys, producing resonance sounds more like a natural musical instrument.

DETAILED DESCRIPTION OF THE PREFERRED EMBODIMENTS

A first embodiment or the invention will be described with reference to FIGS. 1 and 2.

Figure 2:
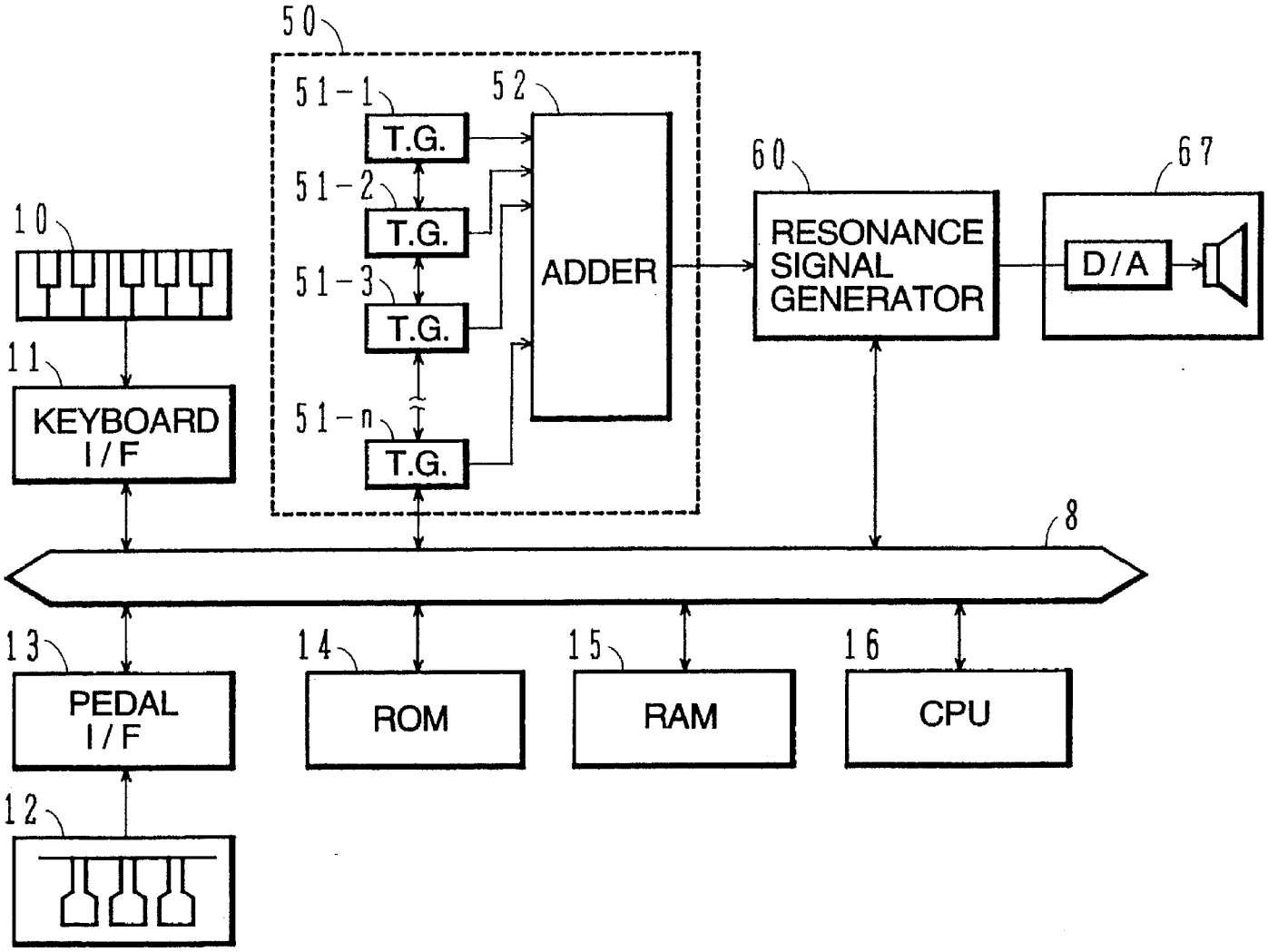
FIG. 2 is a block diagram showing the fundamental structure of a first embodiment of an electronic musical instrument according to the present invention.

FIG. 2 is a block diagram of an electronic circuit of an electronic musical instrument of the first embodiment. A keyboard 10 having a plurality of keys is connected via a keyboard interface 11 to a bus 8. When a key of the keyboard 10 is depressed or released, the keyboard interface 11 detects a pitch of the key, a key depression or release, a speed of key depression or release, after-touch information, and the like, and supplies the detected data to the bus 8.

A pedal 12 is connected via a pedal interface 13 to the bus 8. The pedal interface 13 detects the on/off states of a sustain pedal, a sostenuto pedal, and the like, and supplies the on/off data of each pedal to the bus 8.

A ROM 14, a RAM 15, a CPU 16, a tone signal generator 50, and a resonance signal generator 60 are also connected to the bus 8. CPU 16 runs on the program stored in ROM 14, and controls the tone signal generator 50 and resonance signal generator 60 in accordance with key depression/release information from the keyboard interface 11 and pedal on/off information from the pedal interface 13.

The tone signal generator 50 has a plurality of tone signal forming channels 51-1 to **51-*n* and an adder 52. The tone signal generator 50 generates a tone signal having a pitch corresponding to a depressed key, and gives this tone signal a desired tone color and an amplitude envelope corresponding to the states of a key depression, a key release, and a sustain pedal. When a key is depressed, CPU 16** assigns one of the tone signal forming channels to this key for the generation of a tone signal corresponding to the depressed key. If all the tone signal forming channels are generating tone signals and a new key is depressed, generation of a tone signal having a longest time lapse after the key release or a tone signal most attenuated is stopped and its channel is assigned to the newly depressed key. This process is called a truncate process.

An assigned tone signal forming channel **51-*i*** generates a tone signal having a pitch corresponding to the depressed key.

Each tone signal forming channel 51-1 to **51-*n* is connected to the adder 52. The adder 52 adds tone signals supplied from the tone signal forming channels 51-1 to 51-*n*, and supplies the result to the resonance signal generator 60**.

The resonance signal generator 60 adds a resonance signal to a tone signal inputted from the tone signal generator 50, and supplies the result to a sound system 67. The structure and operation of the resonance signal generator 60 will be later detailed. The sound system 67 converts a digital tone signal inputted from the resonance signal generator 60 into an analog tone signal and produces sounds including resonance sounds.

Figure 1:
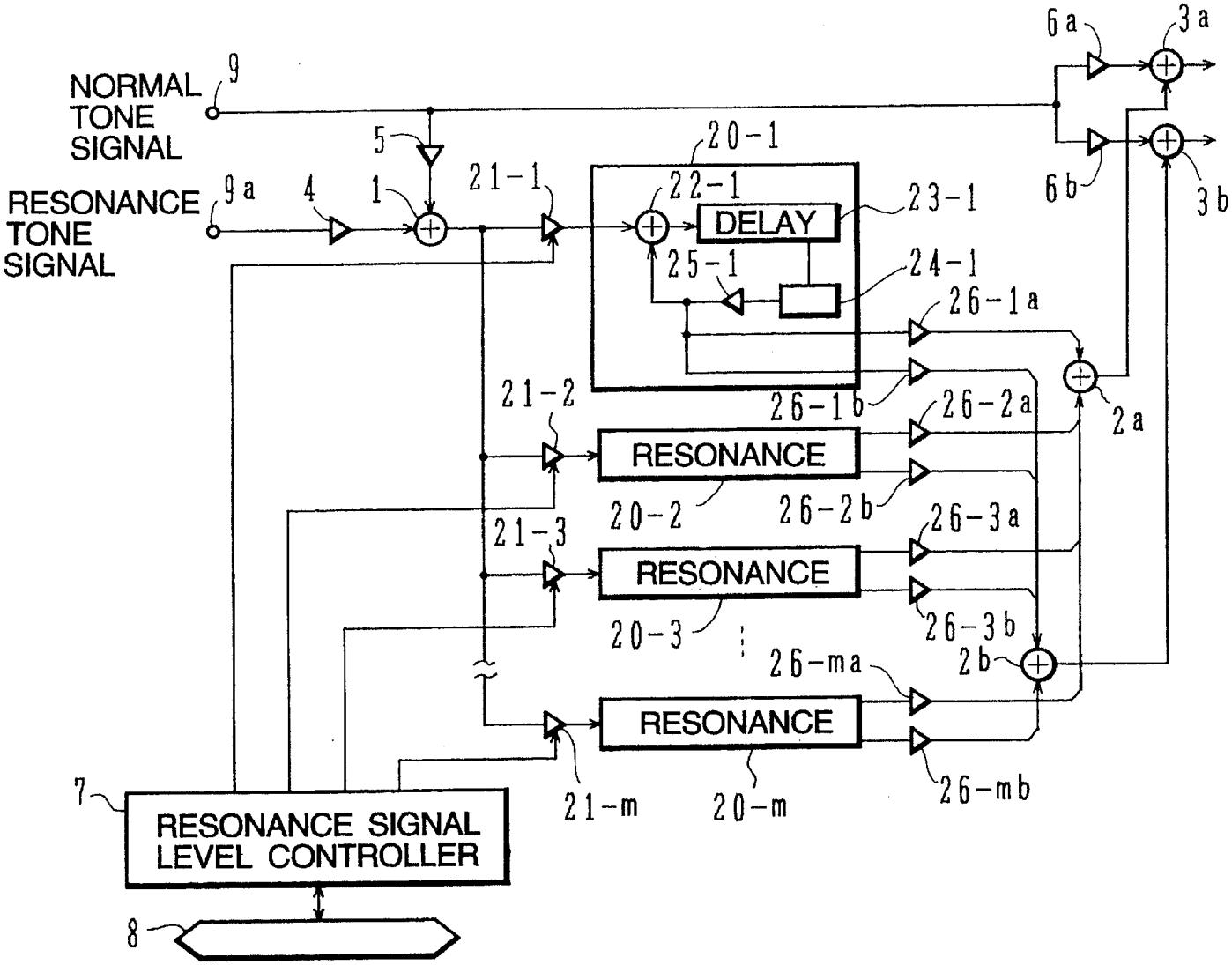
FIG. 1 is a block diagram showing a first embodiment a resonance signal generator according to the present invention.

FIG. 1 is a block diagram of the resonance signal generator 60 shown in FIG. 2. An output of the tone signal generator shown in FIG. 2 is supplied to an input terminal 9. A signal used for generating a resonance signal is applied to an input terminal **9*a*. For example, this signal may be formed of noise components to be used when the sustain pedal is on. Signals applied to the input terminals 9 and 9*a* are supplied via respective multipliers 5 and 4 to an adder 1. An output of the adder 1 is supplied to a plurality of multipliers 21-1 to 21-*m***.

Each multiplier 21-1 to **21-*m* multiplies a tone signal supplied from the adder 1 by a predetermined coefficient, and supplies the result to a corresponding one of resonance signal forming channels 20-1 to 20-*m*. The multipliers 21-1 to 21-*m* are connected to a common resonance level controller 7. The coefficient multiplied to a tone signal is supplied from the resonance level controller 7** in accordance with the pitch information of the tone signal.

Each resonance forming channel 20-1 to **20-*m*** forms a resonance signal specific to each string of a key. It is preferable therefore to provide resonance forming channels as many as the number of keys. If it is difficult to provide channels for all keys, resonance forming channels may be provided only for particular keys, as will be later detailed. For example, twenty four resonance forming channels may be provided for one octave at a high pitch range and another octave at a low pitch range.

Each resonance signal forming channel 20-1 to **20-*m* is formed of a comb filter constituted by a circulating signal path including an adder 22-1 to 22-*m*, a delay circuit 23-1 to 23-*m*, a read controller 24-1 to 24-*m*, and a multiplier 25-1 to 25-*m*. The adder 22-1 to 22-*m* is connected to the multipliers 21-1 to 21-*m* and 25-1 to 21-*m*, adds the tone signals from the multipliers, and supplies the result to the delay circuit 23-1 to 23-*m***.

The delay circuit 23-1 to **23-*m* delays a tone signal supplied from the adder 22-1 to 22-*m* by a predetermined delay time, and outputs it to the read controller 24-1 to 24-*m*. The delay time is set so that the resonance signal forming channel 20-*m* provides a resonance frequency specific to the string of the corresponding key. The read controller 24-1 24-*m* reads the tone signal delayed by the predetermined delay time by the delay circuit 23-1 to 23-*m*, performs an interpolation or phase correction of the read tone signal, and supplies the result to the multiplier 25-1 to 25-*m***.

The multiplier 25-1 to **25-*m* multiplies the tone signal supplied from the read controller 24-1 to 24-*m* by a predetermined coefficient, and supplies the result to the adder 22-1 to 22-*m*. That is to say, the multiplier 25-1 to 25-*m* provides a feedback gain of the comb filter. An output of the multiplier 25-1 to 25-*m* is an output of the resonance signal forming channel 20-1 to 20-*m* which is supplied to multipliers 26-1*a* and 26-1*ma***.

The multipliers **26-1*a* and 26-1*ma* multiply a tone signal supplied from the resonance signal forming channel 20-1 to 20-*m* by predetermined coefficients, and supplies the results to respective adders 2*a* and 2*b*. The multiplier 26-1*a* to 26-1*ma* forms a resonance signal for the left channel, and the multiplier 26-1*ib* forms a resonance signal for the right channel. By properly selecting the coefficients of the multipliers 26-1*a* and 26-1*ma***, a mix ratio of right and left channels, i.e., orientation, can be independently set for each resonance signal of each string.

The adders **2*a* and 2*b* are connected to the multipliers 28-1*a* to 26-*ma* and to the multipliers 26-1*b* to 26-*mb*, and adds the outputs of the respective multipliers, and supply the results to adders 3*a* and 3*b***.

Multipliers **6*a* and 6*b* multiply the tone signal applied to the input terminal 9 by predetermined coefficients, and supply the results to the adders 3*a* and 3*b***.

The adder **3*a* adds a tone signal supplied from the multiplier 6*a* to a left channel resonance signal supplied from the adder 2*a*, to generate a left channel tone signal added with a resonance signal. The adder 3*b* adds a tone signal supplied from the multiplier 6*b* to a right channel resonance signal supplied from the adder 2*b***, to generate a right channel tone signal added with a resonance signal.

The resonance level controller 7 generates each resonance signal control coefficient in accordance with the on/off states of the sustain pedal and sostenuto pedal and the key depression/release state of each key. The resonance signal control coefficient determines the intensity of a tone signal to be inputted to each resonance signal forming channel 20-1 to **20-*m*. This coefficient is supplied to each multiplier 21-1 to 21-*m* from which a tone signal is supplied to each resonance signal forming channel 20-1 to 20-*m***.

For example, when the sustain pedal is on, the resonance signal control coefficient is set to "1" for all the resonance signal forming channels 21-1 to **21-*m*** so as to generate resonance signals of strings of all keys. In this case, the coefficients may be changed in accordance with the distances between the depressed string and other resonating strings.

When the sustain pedal is off, the resonance signal control coefficient of the resonance signal forming channel corresponding to a depressed key is set to "1", and the other resonance signal control coefficients are set to "0". In this manner, it becomes possible to generate a resonance signal only for the string of the depressed key.

Other settings of the resonance signal control coefficient may be made. For example, the coefficient is set to "0.8" for a depressed key, to "0" for a released key, to "0.9" for a depressed key with the sustain pedal being on, and to "0.6" for a released key with the sustain pedal being on. These coefficient values are not limitative.

Next, the operation of the electronic musical instrument and resonance signal generator shown in FIGS. 1 and 2 will be described with reference to FIGS. 6 to 8.

Figure 6:
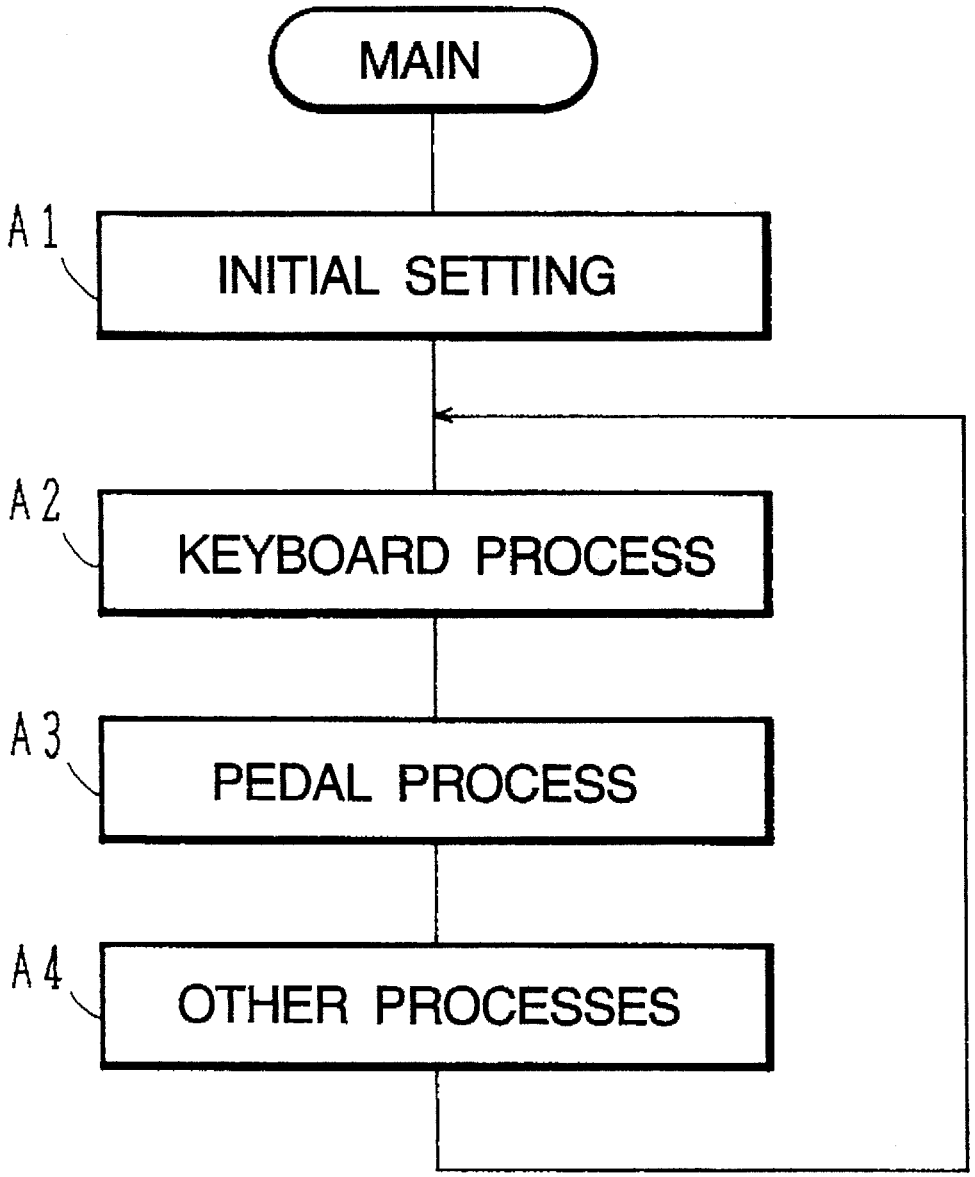
FIG. 6 is a flow chart explaining the main routine of the first embodiment of the invention.

FIG. 6 is a flow chart explaining the main routine. When a power is turned on, each circuit portion is initialized at Step A1. Thereafter, a keyboard process at Step A2, a pedal process at Step A3, and other processes at Step A4 are repetitively executed.

Figure 7:
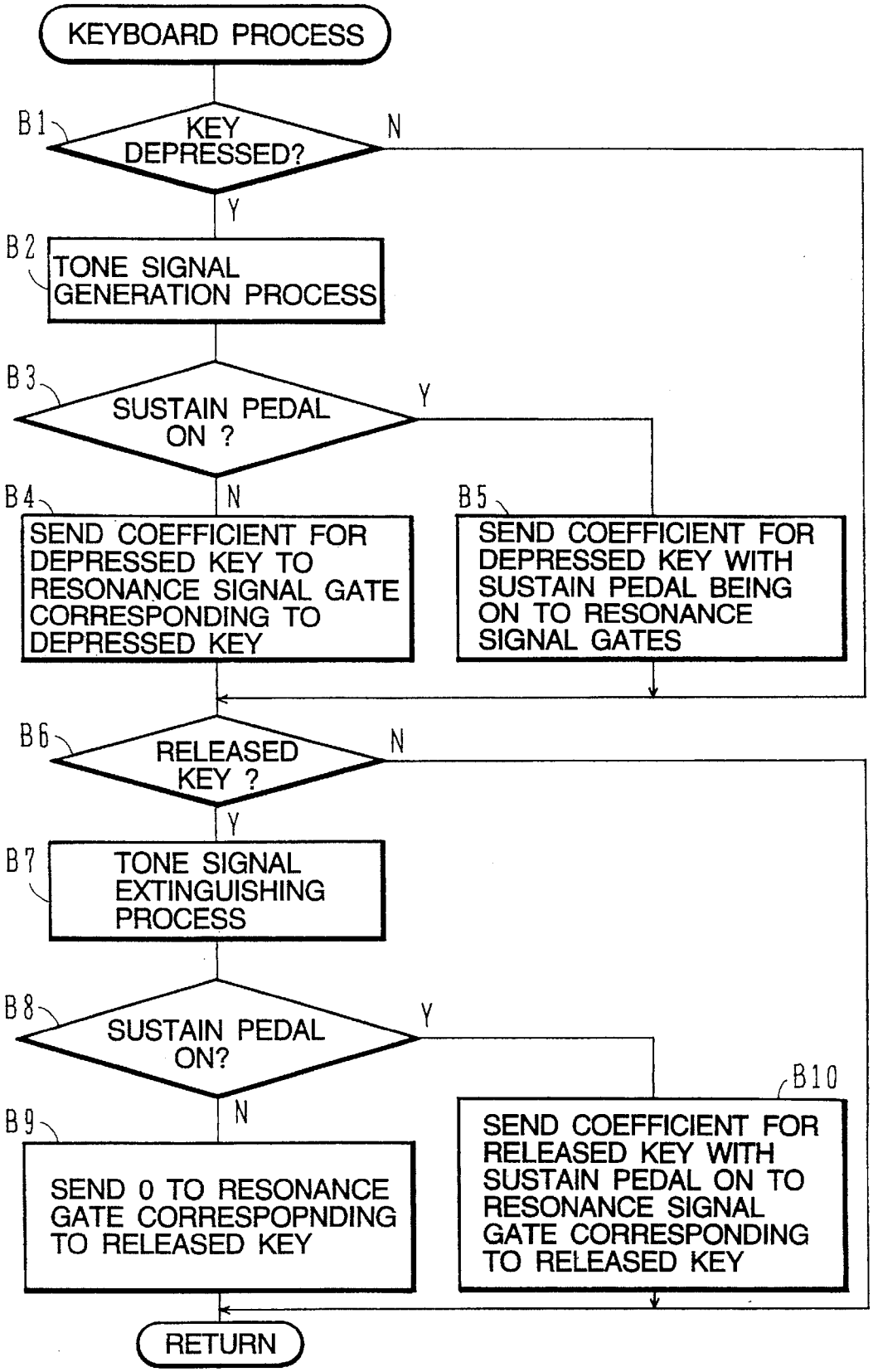
FIG. 7 is a flow chart explaining the keyboard process of the first embodiment of the invention.

FIG. 7 is a flow chart explaining the keyboard process at Step A2 shown in FIG. 6. When the keyboard process is activated from the main routine, a presence/absence of a key depression at a current cycle is detected at Step B1. If there is no key depression, the flow Jumps to step B6 at which a judgement process of a key release presence/absence is performed.

If there is a key depression at a current cycle, a tone signal generation process is executed at Step B2. At this tone signal generation process, CPU 16 assigns one tone signal forming channel **51-*j* to the depressed key, and instructs the assigned tone signal forming channel 51-*j*** to generate a tone signal.

Next, at Step B3, an on/off of the sustain pedal is judged. If the sustain pedal is on, the dampers of all keys detach from the strings, entering the state of allowing resonance. The intensity of resonance becomes different depending upon whether a near key or a far key was struck.

Therefore, at Step B5, CPU 16 causes the resonance level controller 7 to set resonance signal control coefficients for the depressed key with the sustain pedal being on, to the multipliers (hereinafter called resonance signal gates) from which a tone signal is inputted to the resonance signal forming channels.

Typically, the resonance signal control coefficient associated with a particular key is set such that it is proportional to the distance between the particular key and the depressed. In this manner, in accordance with the depressed key, the resonance signal forming channels electronically generate resonance signals of strings when the sustain pedal is on.

If the sustain pedal is off, the damper of only the depressed key detaches from the string, entering the state of allowing resonance. At Step B4, CPU 16 causes the resonance level controller 7 to set a resonance signal control coefficient for the depressed key with the sustain pedal being off, only to the resonance signal gate 21-1 corresponding to the depressed key. In this manner, the resonance signal forming channel electronically generate resonance signal of the depressed key when the sustain pedal is off. Since the string of a key not depressed can also generate resonance a little, the resonance signal gates of the keys not depressed may be opened slightly.

Next, at Step B6, a presence/absence of a key release is checked. If there is no key release at a current cycle, the control returns to the main routine. If there is a key release at a current cycle, a tone signal extinguishing process is executed at Step B7. At this process, CPU 16 causes the tone signal forming channel 51-1 to **51-*n*** corresponding the released key to provide a tone signal extinguishing amplitude envelope. In this case, if the sustain pedal is on, the tone signal extinguishing process is not performed until the pedal becomes off.

After the tone signal extinguishing process, an on/off of the sustain pedal is checked at Step B8. If the sustain pedal is on, at Step B10, CPU 16 causes the resonance signal level controller 7 to set a resonance signal control coefficient for the released key with the sustain pedal being on, to the resonance signal gate **21-*k* corresponding to the released key among the resonance signal gates 21-1 to 21-*m*. In this manner, the resonance signal forming channel 20-1 to 20-*m*** electronically generates a resonance signal of the key released while the sustain pedal is on.

If the sustain pedal is off, at Step B9, CPU 16 causes the resonance level controller 7 to set a resonance signal control coefficient for the released key with the sustain pedal being off, to the resonance signal gate 21-1 to **21-*m* corresponding to the depressed key. In this manner, the resonance signal forming channel 20-1 to 21-*m*** electronically generates a resonance signal of the released key when the sustain pedal is off. In this case, the resonance signal control coefficient may be set to "0" so as not to generate a resonance signal of the released key.

After the completion of the keyboard process, the control returns to the main routine.

Figure 8:
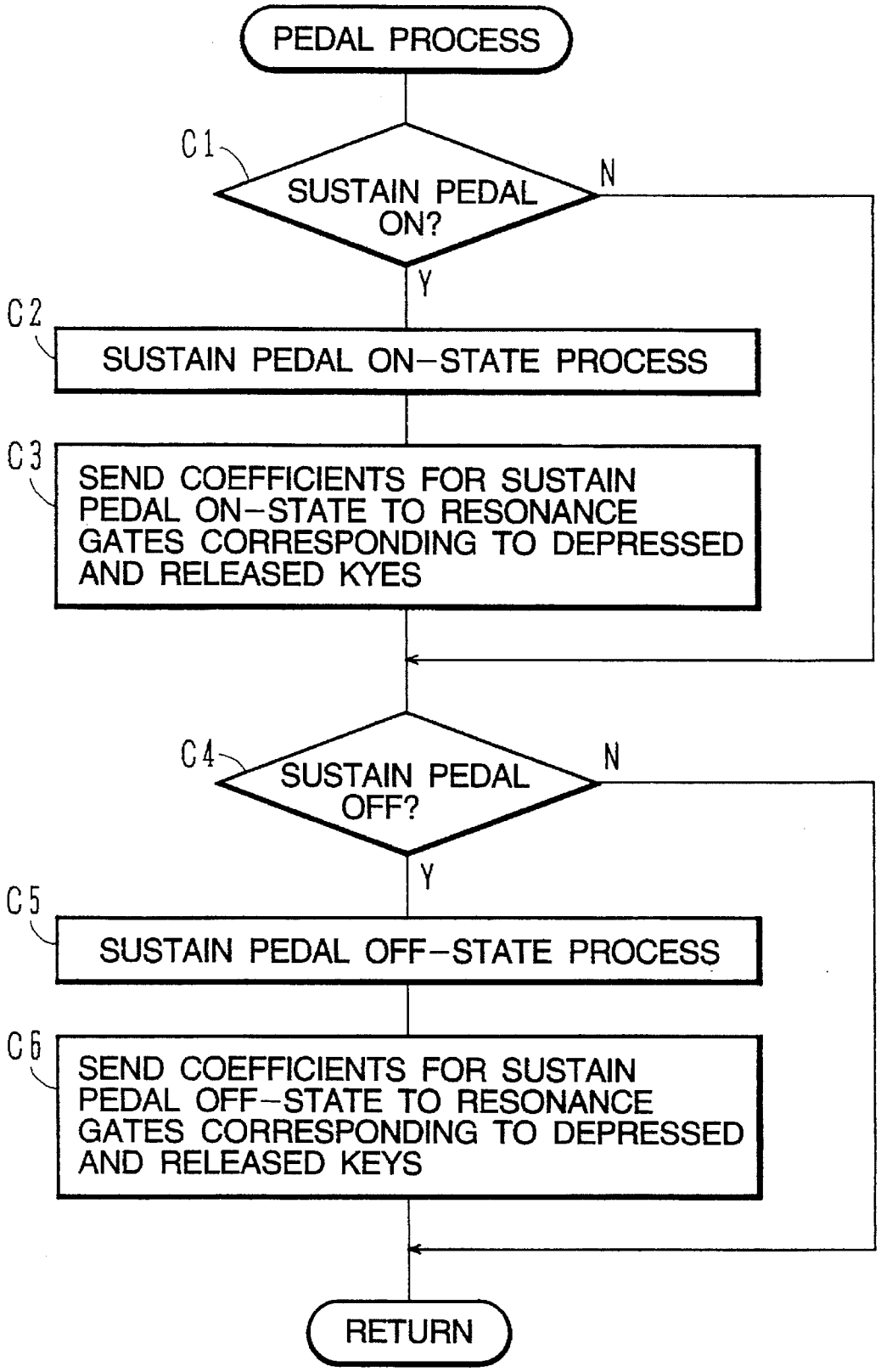
FIG. 8 is a flow chart explaining the pedal process of the first embodiment of the invention.

FIG. 8 is a flow chart explaining the pedal process. When the pedal process is activated from the main routine, it is checked at Step C1 whether the sustain pedal is being depressed at a current cycle. If the sustain pedal is not depressed, the flow jumps to Step C4 at which a judgement process of an on-off of the sustain pedal is executed.

If the sustain pedal is being depressed at a current cycle, a sustain pedal on-state process is executed at Step C2. At this process, CPU 16 stores the on-state of the sustain pedal. At the sustain pedal on-state, the tone signal extinguishing process is not performed even if a key release is detected, until the sustain pedal becomes off.

Next, at Step C3, resonance signal control coefficients for the depressed key with the sustain pedal being on are set to the resonance signal gates corresponding to the depressed keys, and resonance signal control coefficients for the released key with the sustain pedal being on are set to the resonance signal gates corresponding to the released keys. In this manner, each resonance signal forming channel generates a resonance signal when the sustain pedal is on.

Next, it is checked at Step C4 whether the sustain pedal has been released at a current cycle. If the sustain pedal is not released, the current state is maintained and the control returns back to the main routine.

If the sustain pedal has been released at a current cycle, a sustain pedal off-state is executed at Step C5. At this process, CPU 16 stores the off-state of the sustain pedal, and at the same time the tone signal extinguishing process is executed for the key released while the sustain pedal is on.

Next, at Step C6, resonance signal control coefficients for the depressed key with the sustain pedal being off are set to the resonance signal gates corresponding to the depressed keys, and resonance signal control coefficients for the released key with the sustain pedal being off are set to the resonance signal gates corresponding to the released keys. In this manner, each resonance signal forming channel generates a resonance signal when the sustain pedal is off. If the resonance signal control efficient for the released key with the sustain pedal being off is set to "0", a resonance signal forming channel corresponding to the released key stops generating a resonance signal.

After the execution of the pedal process, the control returns back to the main routine.

in the flow charts of FIGS. 7 and 8, only the sustain pedal has been considered for the pedal process for the simplicity of description. When the sostenuto pedal is pushed down, the damper of a depressed key detaches from the string, providing the same condition as the sustain pedal is depressed. The following description takes the sostenuto pedal into consideration.

When an on-state of the sostenuto pedal is detected at Step A3 of the pedal process shown in FIG. 6, CPU 16 stores this on-state. At the on-state of the sostenuto pedal, information of depressed keys is stored in a storage buffer. If a key release is detected, at Step B8 of the tone signal extinguishing process shown in FIG. 7, neither the tone signal extinguishing process nor a re-setting of a resonance signal control coefficient to the corresponding resonance signal gate is performed on condition that the released key information is being stored in the storage buffer. If the released key information is not stored in the storage buffer, the tone signal extinguishing process and a re-setting of a resonance signal control coefficient to a resonance signal gate are performed. In this manner, while the sostenuto pedal is on, the resonance signal forming channel generates the same resonance signal as a key is depressed, even if the key is released.

When an off-state of the sostenuto pedal is detected at Step A3 of the pedal process shown in FIG. 6, CPU 16 stores this off-state. A tone signal extinguishing process is executed for a released key among the keys whose information is being stored in the storage buffer, and a resonance signal control coefficient is set to the resonance signal gate corresponding to the released key. At the same time, the storage buffer is cleared. In this manner, the resonance signal forming channel corresponding to the released key while the sostenuto pedal is on, stop generating a resonance signals.

As described above, this embodiment can electronically generate a resonance signal of the string of a depressed key even if the sustain pedal is off. By properly selecting resonance signal control coefficients in accordance with the on/off state of the sustain pedal and the state of key depression/release, resonance sounds more like a natural musical instrument can be produced.

Consider for example the case where a key of C1 (a tone pitch) and a key of G1 (another tone pitch) are depressed at the same time. The frequency of a sound C1 is 32.7 Hz, and that of a sound G1 is 49 Hz. A frequency ratio is about 2:3. A third harmonic sound of C1 is 98 Hz, and a second harmonic sound of G1 is 98 Hz, and both are generally equal. The string of C1 resonates at the second harmonicfold sound of G1, fourth harmonic sound of G1, and the like. In this embodiment, when the keys of C1 and G1 are depressed at the same time without depressing the sustain pedal, a resonance sound between the strings of C1 and G1 can be produced like a natural musical instrument.

In the above embodiment, the resonance signal generator having resonance signal forming channel corresponding in number to the number of keys. Provision of resonance signal forming channels as many as all keys complicate the circuit. In order to simplify the circuit, resonance signal forming channels may be provided for one octave at a high pitch range and another octave at a low pitch range. A second embodiment of the resonance signal generator will be described with reference to FIG. 3.

Figure 3:
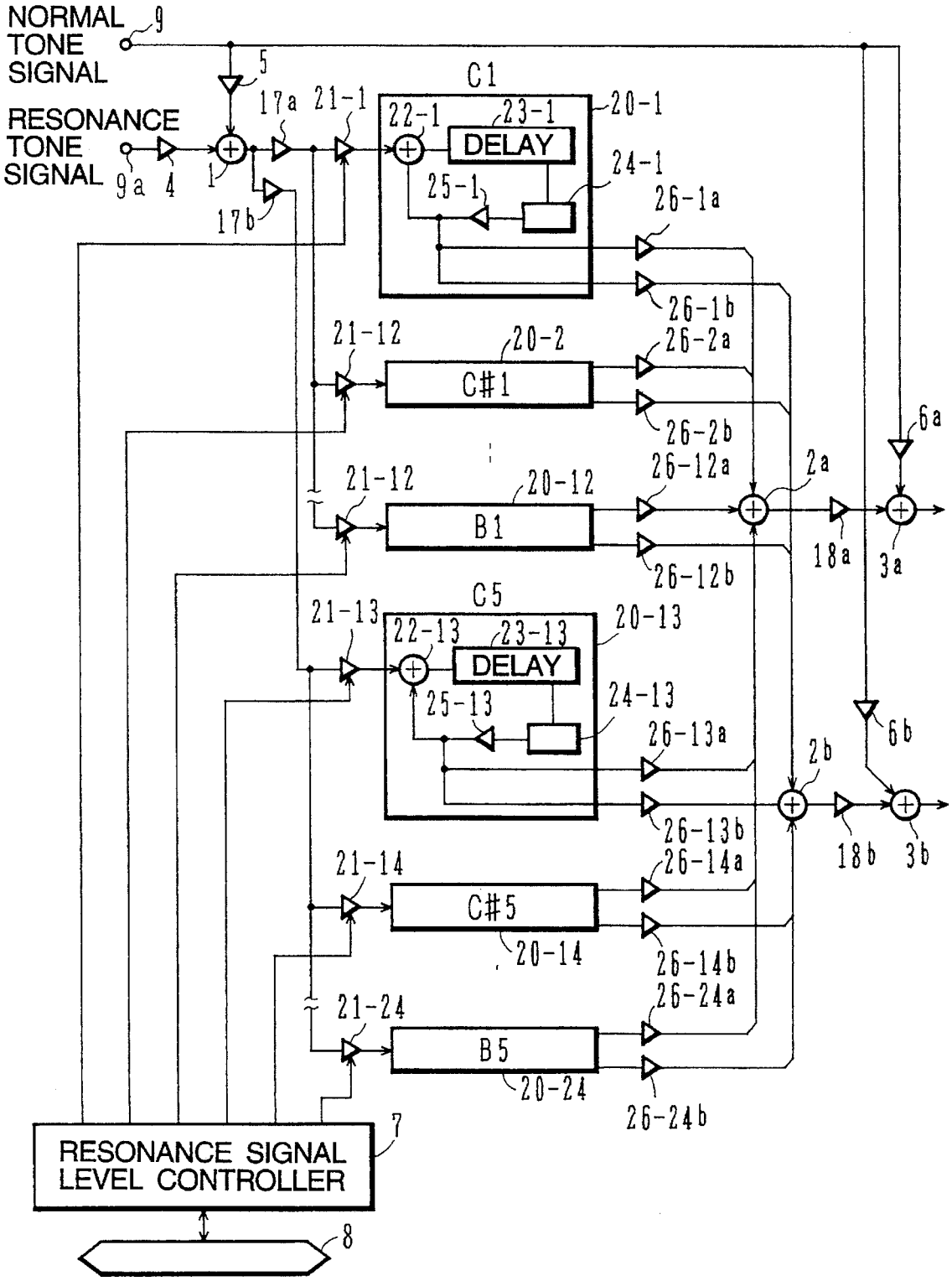
FIG. 3 is a block diagram showing a second embodiment a resonance signal generator according to the present invention.

FIG. 3 is a block diagram of resonance signal forming channels for one octave at a high pitch range and another octave at a low pitch range. The resonance signal generator has twelve resonance signal forming channels 20-1 to 20-12 for a low pitch range and twelve resonance signal forming channels 20-13 to 20-24 for a high pitch range.

The operation of inputting tone signals applied at the input terminals 9 and 9*a* to the adder 1 is the same as the resonance signal generator shown in FIG. 1. An output of the adder 1 is connected to multipliers 17*a* and 17*b* for the supply of a tone signal. The multipliers 17*a* and 17*b* supply a tone signal to resonance signal gates 21-1 to 21-12 for the low pitch resonance signal forming channels and to resonance signal gates 21-13 to 21-24 for the high pitch resonance signal forming channels. If a tone pitch generator is a stereophonic tone pitch generator, a left channel tone signal may be inputted to the resonance signal gates 21-1 to 21-12 for the low pitch resonance signal forming channels, and a right channel tone signal may be inputted to the resonance signal gates 21-13 to 21-24 for the high pitch resonance signal forming channels. This arrangement corresponds to piano strings for a low pitch at the left and piano strings for a high pitch at the right.

The structure of a resonance signal gate 21-1 to 21-*m*, a resonance signal forming channel 20-1 20-*m*, and multipliers 26-*ia* and 26-1*b* to 26-*mb* is the same as the resonance signal generator shown in FIG. 1. An output of each multiplier 26-1*a* to 26-*ma*, 26-1*b* to 26-*mb* is supplied to respective adders 2*a* and 2*b*.

The adders 2*a* and 2*b* supply a tone signal to multipliers 18*a* and 18*b*. Adders 3*a* and 3*b* add the tone signals supplied from the multipliers 6*a* and 6*b* to corresponding resonance signals supplied from the multipliers 18*a* and 18*b*, to form and output a tone signal added with a resonance signal.

A resonance signal level controller 7 generates resonance signal control coefficients in accordance with the on/off states of the sustain pedal and sostenuto pedal and the key depression/release state of the keyboard, and supplies them to the resonance signal gates of the low pitch resonance signal forming channels 20-1 to 20-13 and to the resonance signal gates of the high pitch resonance signal forming channels 20-13 to 20-24.

In the resonance signal generator shown in FIG. 3, it occurs that a depressed key has no corresponding resonance signal forming channel. In this case, the resonance signal gates of the high pitch resonance signal forming channel and low pitch resonance signal forming channel, corresponding to a depressed key, are set with appropriate resonance signal control coefficients, to simulate a resonance signal of a depressed key.

For example, consider that there are prepared the low pitch resonance signal forming channels for one octave from a sound C1 to B1 and the high pitch resonance signal forming channels for one octave from a sound C5 to B5.

The resonance signal control coefficient of each resonance signal gate can be adjusted in the following manner, in accordance with a depressed key.

When a key corresponding to C1 is depressed, the resonance signal control coefficient of the resonance signal gate 21-1 of the low pitch resonance signal forming channel corresponding to C1 is set to "1", and the resonance signal control coefficient of the resonance signal gate 21-13 of the high pitch resonance signal forming channel corresponding to C5 is set to "0".

Conversely, when a key corresponding to C5 is depressed, the resonance signal control coefficient of the resonance signal gate 21-1 of the low pitch resonance signal forming channel corresponding to C1 is set to "0", and the resonance signal control coefficient of the resonance signal gate 21-13 of the high pitch resonance signal forming channel corresponding to C5 is set to "1".

When a key corresponding to C3 is depressed, the resonance signal control coefficient of the resonance signal gate 21-1 of the low pitch resonance signal forming channel corresponding to C1 and the resonance signal control coefficient of the resonance signal gate 21-13 of the high pitch resonance signal forming channel corresponding to C5 are both set to "0.5".

When a key different from the above-described keys is depressed, it is preferable to adjust the ratio of the resonance signal control coefficients to be set to the resonance gates for the high and low pitch ranges, in order to produce an optimum resonance sound.

As described above, the resonance signal generator of the second embodiment is not necessary to provide resonance signal forming channels as many as the number of keys, allowing the electronic circuit to be simplified. Furthermore, by properly setting the resonance signal control coefficients for the high and low pitch ranges, it becomes possible to produce a resonance sound more like resonance sound of each key.

Figure 4:
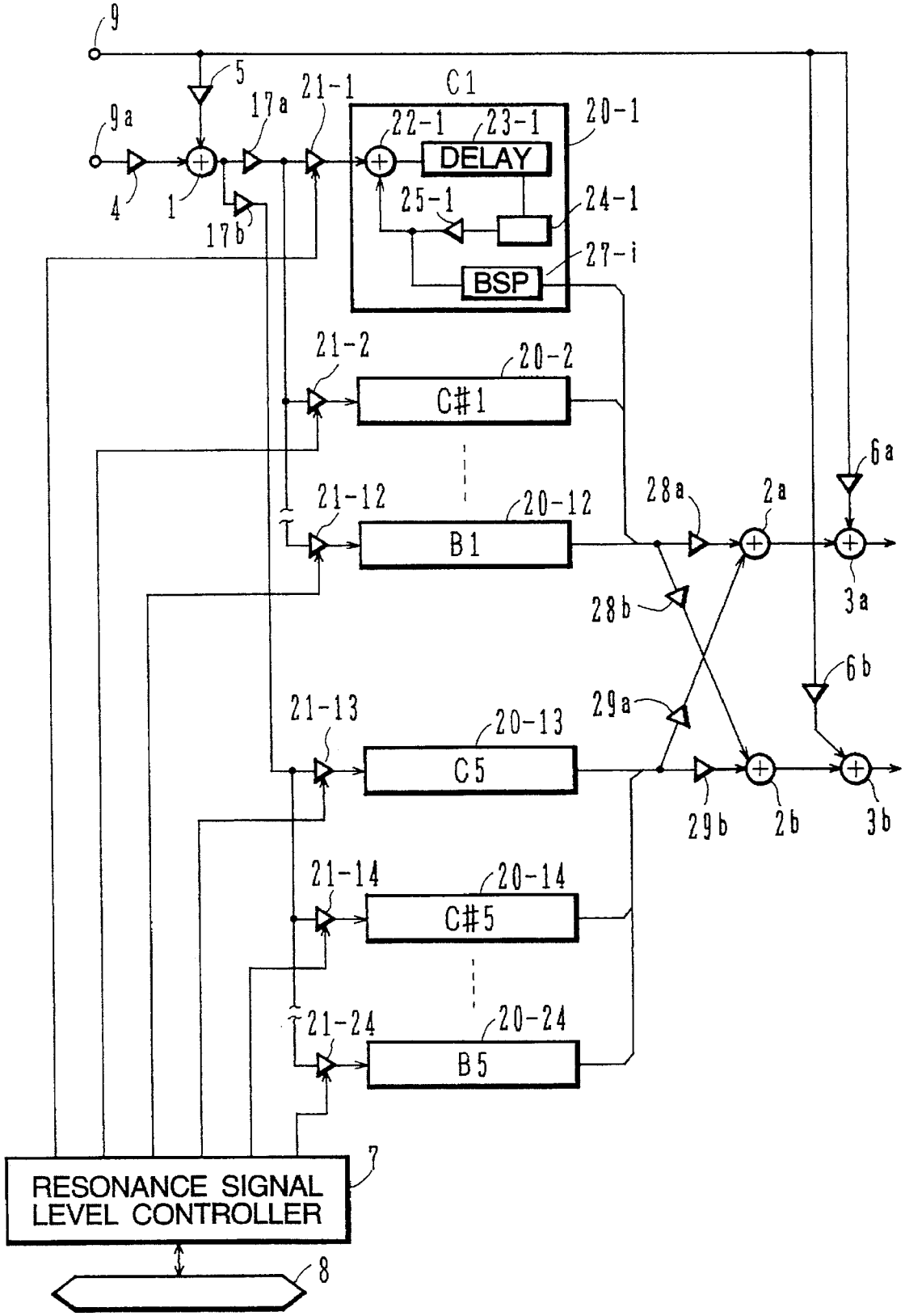
FIG. 4 is a block diagram showing a third embodiment a resonance signal generator according to the present invention.
Figure 5:
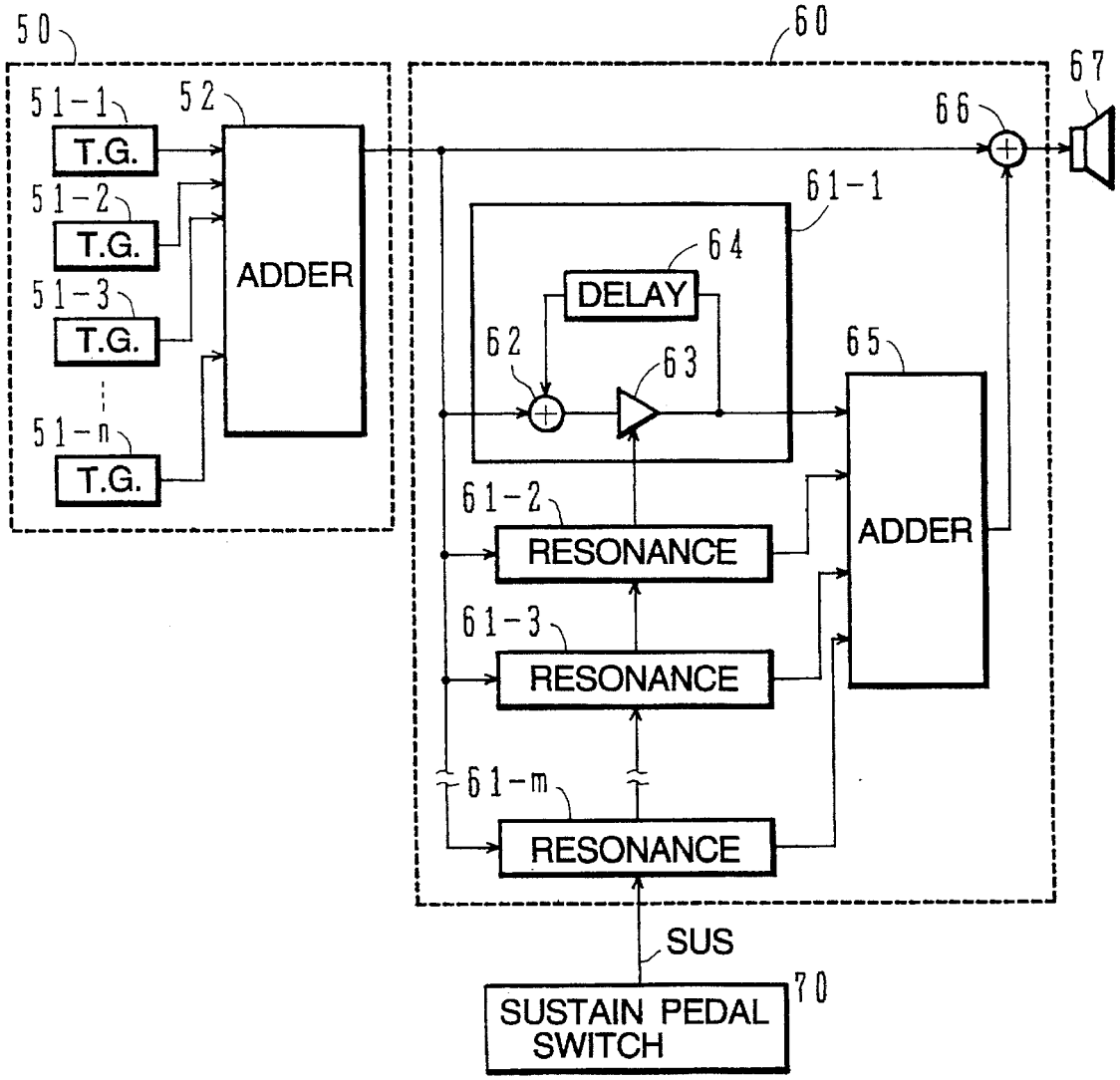
FIG.5 (PRIOR ART)
FIG. 5 is a block diagram showing a conventional tone signal generator and resonance signal generator.

Next, a third embodiment will be described with reference to FIG. 4.

A hammer of a piano strikes the string at the position about 1/7 to 1/9 of the string length from one end thereof. A standing wave having node at the position about 1/7 to 1/9 of the string length from one end thereof, is therefore difficult to be generated. This means that seventh to ninth harmonic sounds of the fundamental frequency of a string is difficult to be generated. In the third embodiment shown in FIG. 4, each resonance signal forming channel is provided with a band-elimination or band-stop filter which stops the signal pass at the band corresponding to seventh to ninth harmonic sounds of the fundamental frequency of each string.

The operation of inputting tone signals applied at the input terminals 9 and 9*a* to the adder 1 and to each resonance signal forming channel 20-1 to 20-24 is the same as the second embodiment shown in FIG. 3. A circulating signal path of each resonance signal forming channel 20-1 to 20-*m* constituted by an adder 20-1 to 20-*m*, a delay circuit 23-1 to 23-*m*, a read controller 24-*m*, and a multiplier 25-1 to 25-*m* is the same as the second embodiment shown in FIG. 3. The different points reside in that an output of the multiplier 25-1 to 25-*m* is supplied to the band-elimination filter 27-1 to 27-*m* and that an output of this filter is an output of the resonance signal forming channel 20-1 to 20-*m*. Therefore, seventh to ninth harmonic sounds of the fundamental frequency of a string is prevented from being generated, allowing to generate a resonance sound more like a piano resonance sound.

The above embodiment uses a band-elimination filter. Instead, a low-pass filter stopping a frequency of seventh harmonic sound or higher may be used.

Outputs of the low pitch resonance signal forming channels 20-1 to 20-12 are added together and supplied to multipliers 28*a* and 28*b*. Outputs of the high pitch resonance signal forming channels 20-13 to 20-24 are added together and supplied to multipliers 29*a* and 29*b*. Outputs of the multipliers 28*a* and 29*a* are added by an adder 2*a* to form a left channel resonance signal. Outputs of the multipliers 29*a* and 29*b* are added by an adder 2*b* to form a right channel resonance signal.

In the second embodiment shown in FIG. 3, an output of each resonance signal forming channel is separated into right and left channel resonance signals, and the right and left channel resonance signals are inputted to the adders 2*a* and 2*b* via the multipliers. In the third embodiment, outputs of the resonance signal forming channels are added and then inputted to the right and left channel multipliers. Therefore, interference between the right and left resonance signal forming channels can be used. In addition, the number of multipliers can be reduced, simplifying the electronic circuit.

A piano has strings for generating low pitch sounds on the left side, and strings for generating high pitch sounds on the right side. Therefore, in separating resonance signals generated by the low pitch resonance signal forming channel into the right and left channels, it is preferable to raise the level of the left channel signal and lower the level of the right channel signal. On the other hand, in separating resonance signals generated by the high pitch resonance signal forming channel into the right and left channels, it is preferable to lower the level of the left channel signal and raise the level of the right channel signal. As in the third embodiment, the right and left channel signals are separated after the outputs of the low pitch resonance signal forming channels are added and the outputs of the high pitch resonance signal forming channels are added. By changing the levels of the right and left channel signals independently, an effective resonance sound can be produced.

The present invention has been described in connection with the preferred embodiments. The invention is not limited only to the above embodiments. It is apparent to those skilled in the art that various modifications, improvements, combinations and the like can be made without departing from the scope of the appended claims. For example, an output of each resonance signal forming channel may be taken out from a desired point of the loop circuit, such as from an output of the adder 22-1 to 22-*m*.

I claim:

1. An electronic musical instrument comprising:

a plurality of keys each having a pitch associated therewith;

key state detection means for detecting at least a depressed state and a released state of each one of said keys;

at least one pedal;

pedal state detection means for detecting at least a depressed state and a released state of said at least one pedal;

tone signal generating means for selectively generating a plurality of tone signals each having a pitch associated with a depressed key;

mixing means for producing a mixed tone signal by mixing tone signals generated by said tone signal generating means;

a plurality of resonance signal generating means for receiving a mixed tone signal from said mixing means and generating and outputting a plurality of different resonance signals;

input level controlling means for controlling a level of said mixed tone signal, at least one level of said mixed tone signal being input to said plurality of resonance signal generating means; and control means for controlling said tone signal generating means to generate a tone signal having a pitch associated with a depressed key when said key state detection means detects depression of one of said plurality of keys, and when said pedal state detection means detects that said at least one pedal is in said released state, said control means controlling said input level controlling means in accordance with a pitch of said one of said plurality of keys such that a level of said mixed tone signal input to at least one of said plurality of resonant signal generating means corresponds to said pitch associated with said depressed key.

2. An electronic musical instrument according to claim 1, wherein each of said plurality of resonance signal generating means comprises a comb filter forming a circulating signal path including an adder, a delay circuit, and means for providing feedback gain.

3. An electronic musical instrument according to claim 1, wherein for every one of said pitches associated with said plurality of keys, there is a corresponding resonance signal generating means.

4. An electronic musical instrument according to claim 1, wherein for every pitch associated with said plurality of keys in a first octave and a second octave, there is a corresponding resonance signal generating means.

5. An electronic musical instrument according to claim 1, further comprising:

left channel mixing means for mixing resonance signals generated by said plurality of resonance signal generating means;

right channel mixing means for mixing resonance signals generated by said plurality of resonance signal generating means;

at least one first resonance signal level controlling means for controlling at least one level of said resonance signals input to said right channel mixing means; and at least one second resonance signal level controlling means for controlling at least one level of said resonance signals input to said left channel mixing means.

6. An electronic musical instrument according to claim 1, wherein each of said plurality of resonance signal generating means further includes a band-elimination filter.

7. An electronic musical instrument according to claim 1, further comprising:

adding means for adding a resonance tone signal to said mixed signal; and resonance tone signal level controlling means for controlling a level of said resonance tone signal added to said mixed signal.

8. An electronic musical instrument according to claim 4, wherein said input controlling means further includes:

means for sending at least one control coefficient to at least one of said resonance signal generating means that corresponds to a pitch in said first octave and sending at least one control coefficient to at least one of said resonance signal generating means that corresponds to a pitch in said second octave.

9. An electronic musical instrument according to claim 6, wherein said band-elimination filter prevents passage of seventh to ninth harmonic frequencies of a fundamental frequency of said resonance signal generated by said resonance signal generating means.

10. An electronic musical instrument according to claim 4, wherein each of said plurality of resonance signal generating means comprises a comb filter forming a circulating signal path including an adder, a delay circuit, and means for providing feedback gain.

11. An electronic musical instrument according to claim 1, wherein said at least one pedal is a sustain pedal, said electronic musical instrument further including:

activation means, responsive to a detection of said depressed state of said sustain pedal by said pedal state detection means, for controlling said input level controlling means corresponding to a pitch associated with a depressed one of said keys.

12. An electronic musical instrument according to claim 1, wherein said at least one pedal is a sostenuto pedal, said electronic musical instrument further including:

activation means, responsive to a detection of said depressed state of said sostenuto pedal by said pedal state detection means, for controlling said input level controlling means corresponding to a pitch associated with a depressed one of said keys.

13. An electronic musical instrument according to claim 12, further comprising a memory for storing a pitch associated with a depressed key as detected by said key state detection means when said sostenuto pedal is in said depressed state as detected by said pedal state detection means.

14. An electronic musical instrument according to claim 1, wherein said control means controls said input level controlling means in accordance with control coefficients determined in accordance with a state of said at least one pedal.

15. An electronic musical instrument according to claim 14, wherein a control coefficient supplied by said control means to said input level controlling means when said at least one pedal is in said depressed state is different than a control coefficient supplied to said input level controlling means when said at least one pedal is in said released state.

16. An electronic musical instrument according to claim 14, wherein a control coefficient supplied by said control means to said input level controlling means when one of said keys is in said depressed state and said at least one pedal is in said depressed state is different than a control coefficient supplied to said input level controlling means when said one of said keys is in said depressed state and said at least one pedal is in said released state.

17. An electronic musical instrument according to claim 14, wherein a control coefficient supplied by said control means to said input level controlling means when one of said keys is in said released state and said at least one pedal is in said depressed state is different than a control coefficient supplied to said input level controlling means when said one of said keys is in said released state and said at least one pedal is in said released state.

18. An electronic musical instrument according to claim 14, wherein said pedal is a sostenuto pedal and said control means includes:

means for storing a pitch of a depressed key when said key state detecting means detects that one of said keys changes from said depressed state to said released state and said pedal detecting means detects that said sostenuto pedal is in said depressed state; and means, responsive to said stored pitch and said key state detection means, for terminating tone generation by said tone signal generating means and controlling said input level controlling means if said released key does not correspond to said stored pitch.

19. An electronic musical instrument according to claim 18, wherein said controller further comprises:

means for terminating generation by said tone signal generating means of a tone signal having a pitch associated with one of said plurality of keys when said key state detecting means detects that a state of said one of said plurality of keys changes from said depressed state to said released state and said pedal detecting means detects that said sostenuto pedal is in said released state; and means for changing a control coefficient being supplied to said input level controlling means when said key state detecting means detects that said state of said one of said keys changes from said depressed state to said released state and said pedal detecting means detects that said sostenuto pedal is in said released state.

20. A resonance signal generating method comprising the steps of:

detecting at least a depressed and a released state of each of a plurality of keys;

detecting at least a depressed and a released state of at least one pedal;

generating tone signals each having a pitch that corresponds to a depressed one of said plurality of keys;

mixing said tone signals to obtain a mixed tone signal;

controlling, when said pedal is off, a level of said mixed tone signal input to each of a plurality of resonance signal generators having a different resonance frequency characteristic in accordance with a pitch of said tone signal to be generated, and inputting said level controlled mixed tone signal to respective ones of said resonance signal generators corresponding to tone signals to be generated; and generating and outputting a plurality of different resonance signals in accordance with said level controlled mixed tone signal.

21. A resonance signal generating method according to claim 20, wherein said controlling step further comprises the step of:

controlling levels of said mixed tone signal input to said respective ones of said resonance signal generators such that said mixed tone signal is input only to resonance signal generators that correspond to pitches associated with depressed ones of said keys.

22. A resonance signal generating method according to claim 20, wherein said pedal is a sostenuto pedal, and wherein said controlling step further comprises the step of:

when said sostenuto pedal is in a depressed state, supplying said mixed tone signal at a first level to predetermined ones of said resonance signal generators in order to generate a resonance signal having a frequency that corresponds to depressed ones of said plurality of keys and supplying said mixed tone signal to others of said resonance signal generators at a second level, wherein said first level is greater than said second level.

23. A resonance signals generating method according to claim 20, wherein said pedal is a sustain pedal, and wherein said controlling step further comprises the step of:

supplying said mixed tone signal to all of said resonance signal generators when said sustain pedal is in an depressed state.

24. A machine readable media containing instructions for causing a machine to perform the resonance signal generating method of claim 20.

25. A machine readable media containing instructions for causing a machine to perform the resonance signal generating method of claim 21.

26. A machine readable media containing instructions for causing a machine to perform the resonance signal generating method of claim 22.

27. A machine readable media containing instructions for causing a machine to perform the resonance signal generating method of claim 23.

* * * * *